US005190015A

United States Patent [19]

Nakata et al.

[11] Patent Number: 5,190,015

[45] Date of Patent: Mar. 2, 1993

[54] EVAPORATED FUEL DISCHARGE SUPPRESSING APPARATUS FOR AN INTERNAL COMBUSTION ENGINE

[75] Inventors: Kunihiko Nakata; Mamoru Yoshioka, both of Susono; Toshihisa Sugiyama, Gotenba; Yuji Kanto, Susono, all of Japan

[73] Assignee: Toyota Jidosha Kabushiki Kaisha, Toyota, Japan

[21] Appl. No.: 830,910

[22] Filed: Feb. 4, 1992

[30] Foreign Application Priority Data

Feb. 5, 1991 [JP] Japan ..... 3-35322
Feb. 5, 1991 [JP] Japan ..... 3-35323

[51] Int. Cl.[5] ..... F02M 33/02

[52] U.S. Cl. ..... 123/520; 123/519; 123/518; 60/612

[58] Field of Search ..... 123/516, 518, 519, 520, 123/521, 198 D, 494, 479; 60/612

[56] References Cited

U.S. PATENT DOCUMENTS

| | | | |
|---|---|---|---|
| 4,212,276 | 7/1980 | Kaneda | 123/519 |
| 4,308,842 | 1/1982 | Watanabe et al. | 123/519 |
| 4,411,241 | 10/1983 | Ishida | 123/518 |
| 4,505,248 | 3/1985 | Yuzawa et al. | 123/518 |
| 4,527,532 | 7/1985 | Kasai et al. | 123/518 |
| 4,541,396 | 9/1989 | Sato et al. | 123/518 |
| 4,630,581 | 12/1986 | Shibata | 123/520 |
| 4,655,189 | 4/1987 | Koga | 123/519 |
| 4,658,796 | 4/1987 | Yoshida et al. | 123/516 |
| 4,700,683 | 10/1987 | Uranishi et al. | 123/519 |
| 4,705,007 | 11/1987 | Plapp et al. | 123/519 |
| 4,741,317 | 5/1988 | Yost | 123/518 |
| 4,809,667 | 3/1989 | Uranishi et al. | 123/518 |
| 4,817,576 | 4/1989 | Abe et al. | 123/516 |
| 4,867,126 | 9/1989 | Yonekawa et al. | 123/520 |
| 4,919,103 | 4/1990 | Ishiguro et al. | 123/519 |
| 4,951,643 | 8/1990 | Sato et al. | 123/519 |
| 5,005,550 | 4/1991 | Bugin, Jr. et al. | 123/520 |
| 5,020,503 | 6/1991 | Kanasashi | 123/519 |
| 5,050,568 | 9/1991 | Cook | 123/518 |
| 5,056,494 | 10/1991 | Kayanuma | 123/516 |
| 5,069,188 | 12/1991 | Cook | 123/516 |

FOREIGN PATENT DOCUMENTS

| | | | |
|---|---|---|---|
| 52-21524 | 2/1977 | Japan | 123/519 |
| 56-77545 | 6/1981 | Japan | 123/519 |
| 59-136554 | 8/1984 | Japan . | |
| 61-19962 | 1/1986 | Japan . | |
| 62-20669 | 1/1987 | Japan . | |
| 242168 | 2/1990 | Japan . | |
| 261173 | 5/1990 | Japan . | |

*Primary Examiner*—E. Rollins Cross
*Assistant Examiner*—Thomas Moulis
*Attorney, Agent, or Firm*—Cushman, Darby & Cushman

[57] ABSTRACT

An evaporated fuel discharge suppressing apparatus includes a main purge conduit and a bypass purge conduit. The main purge conduit connects a canister and an intake conduit of an engine downstream of a throttle valve, and a purge control solenoid valve is installed in the main purge conduit. The bypass purge conduit bypasses the purge control solenoid valve. Even if the purge control solenoid valve sticks in a closed position, evaporated fuel adsorbed by the canister can flow into the intake conduit of the engine through the bypass purge conduit so that the evaporated fuel in the canister is not discharged into the atmosphere.

20 Claims, 9 Drawing Sheets

M1

| GN \ NE | 800rpm | 1600rpm | 2400rpm |
|---|---|---|---|
| 0.25g/rev | 0% | 50% | 100% |
| 0.50g/rev | 0% | 80% | 100% |
| 0.75g/rev | 60% | 100% | 100% |

EVAPORATED FUEL DISCHARGE SUPPRESSING APPARATUS FOR AN INTERNAL COMBUSTION ENGINE

BACKGROUND OF THE INVENTION

1. Field of the Invention

The present invention relates to an evaporated fuel discharge suppressing apparatus for an internal combustion engine wherein evaporated fuel gas generated in a fuel tank is lead to an engine combustion chamber so that discharge of the evaporated fuel to the atmosphere is suppressed.

2. Description of the Prior Art

For preventing pollution of the atmosphere, evaporated fuel generated in a fuel tank of an automobile is introduced into an intake conduit of an engine to be burned in a combustion chamber of the engine together with supplied fuel. More particularly, the evaporated fuel is temporarily adsorbed by a canister, for example a charcoal canister, and then is introduced into the intake conduit of the engine by a negative pressure of the intake conduit when the engine is operated.

Japanese Patent Publication No. SHO 61-19962 discloses an evaporated fuel discharge suppressing apparatus wherein a purge control solenoid valve is installed in a purge conduit connecting a canister and a portion of an engine intake conduit downstream of an intake throttle valve and the purge amount of evaporated fuel gas is optimized by controlling the purge control solenoid valve by duty control.

However, if the purge control valve experiences problems and sticks in an open position, a large amount of evaporated fuel will flow from the canister into the intake conduit of the engine when the throttle valve is fully closed at idling or deceleration. As a result, the air-fuel ratio of the engine will vary largely to cause an engine stall or misfiring. Further, due to such engine misfiring, unburned fuel will be generated in the engine and will remain in an exhaust purification catalyst installed in an exhaust conduit of the engine. The remaining fuel may melt the catalyst when it is burned.

To solve the above-described problem, Japanese Utility Model Publication No. HEI 2-61173 proposes to install a control valve in the purge conduit in series with the purge control valve so that the control valve can close the purge conduit even if the purge control valve is stuck in the opened position.

However, even in such an evaporated fuel discharge suppressing apparatus wherein the purge control valve and another control valve are arranged in series in the purge conduit, there is a problem that if the purge control valve or the control valve experiences problems and sticks in the closed position, the evaporated fuel cannot be purged into the intake conduit of the engine so that collecting evaporated fuel will eventually exceed the adsorption capacity of the canister and will be discharged into the atmosphere via a canister vent port, resulting in a gasoline odor.

SUMMARY OF THE INVENTION

An object of the invention is to provide an apparatus which can prevent an evaporated fuel from being discharged from a canister into the atmosphere even if a purge control valve installed in a purge conduit experiences problems and sticks in a closed position.

This object is attained by an evaporated fuel discharge suppressing apparatus in accordance with the present invention which includes: an internal combustion engine having an intake conduit in which a butterfly-type intake throttle valve is installed, the butterfly-type throttle valve having a trailing, outermost edge; a fuel tank; a canister, connected to the fuel tank through an evaporated fuel conduit, for adsorbing evaporated fuel generated in the fuel tank and flowing to the canister; a main purge conduit connecting the canister and a portion of the intake conduit downstream of the intake throttle valve; a purge control solenoid valve, installed in the main purge conduit, for controlling the purge amount of evaporated fuel by duty control in response to an engine operating condition; and a bypass purge conduit having an upstream end and a downstream end and bypassing the purge control solenoid valve, the upstream end of the bypass purge conduit being connected to either one of the canister and a portion of the main purge conduit upstream of the purge control solenoid valve, and the downstream end of the bypass purge conduit being connected to a portion of the intake conduit of the engine which is located upstream of the trailing outermost edge of the butterfly-type intake throttle valve when the intake throttle valve is fully closed and is located downstream of the trailing outermost edge of the butterfly-type intake throttle valve when the intake throttle valve is opened. The downstream end of the bypass conduit may be connected to a portion of the main purge conduit downstream of the purge control solenoid valve.

In the above-described apparatus, since the bypass purge conduit is provided, the evaporated fuel can flow into the intake conduit of the engine through the bypass purge conduit, even if the purge control solenoid valve or the vacuum switching valve experiences problems and sticks in the closed position.

BRIEF DESCRIPTION OF THE DRAWING

The above and other objects, features, and advantages of the present invention will become more apparent and will be more readily appreciated from the following detailed description of the preferred embodiments of the invention taken in conjunction with the accompanying drawings, in which.

DETAILED DESCRIPTION OF THE PREFERRED EMBODIMENTS

Four embodiments of the invention will be explained. First, structures common to every embodiment will be explained with reference to, for example, FIGS. 1-7.

Figure 2:
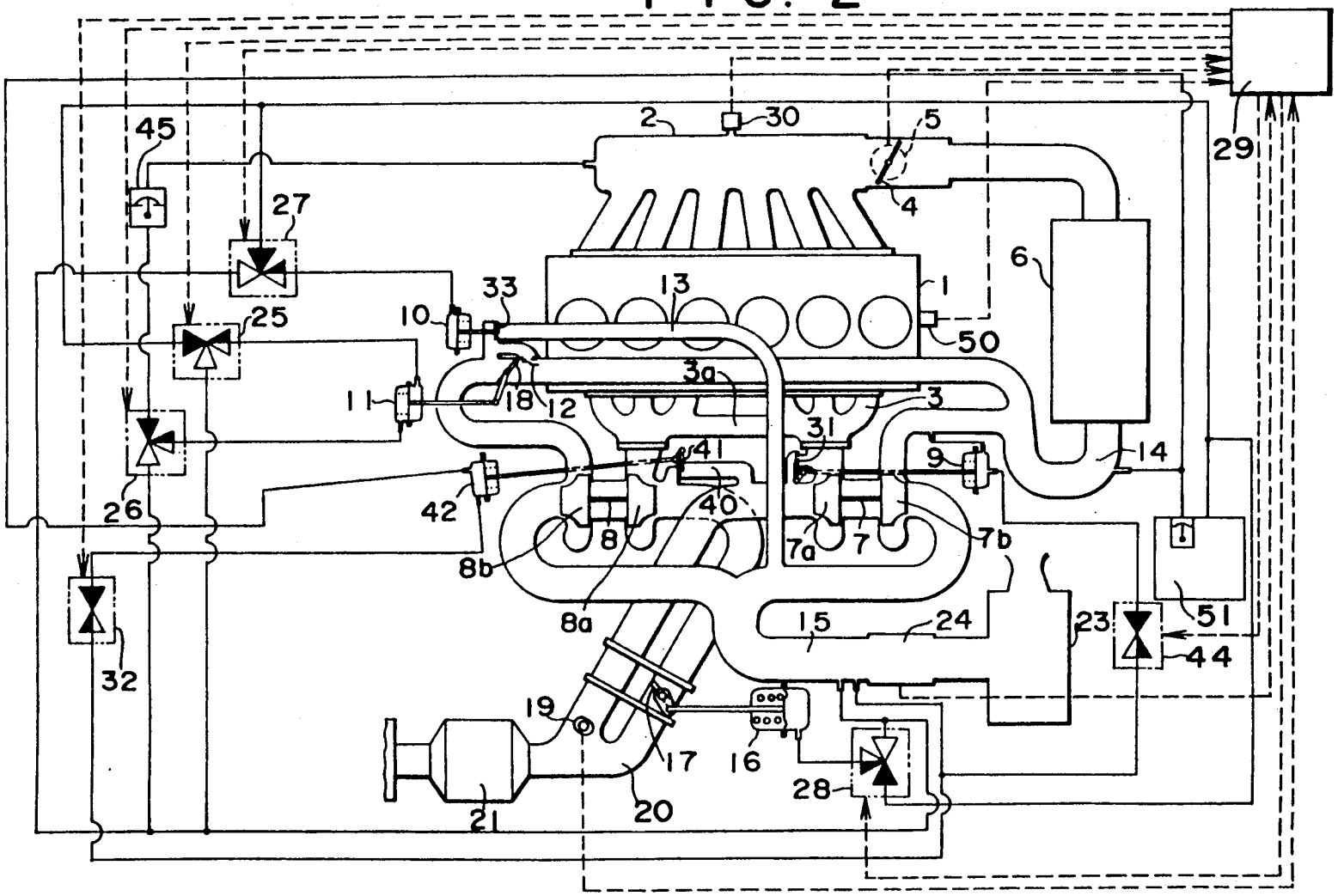
FIG. 2 is a schematic system diagram of a twin-turbocharged engine to which the apparatus of FIG. 1 is mounted.

FIG. 2 illustrates one example of an engine to which an evaporated fuel discharge suppressing apparatus of the invention can be mounted. As illustrated in FIG. 2, an internal combustion engine with a dual turbocharger system includes a multi-cylinder engine, for example, a six-cylinder internal combustion engine 1 with an air intake and an exhaust conduit. The cylinders of the engine 1 are grouped into two groups. An exhaust manifold 3 is connected to the engine exhaust outlet and includes a first portion connected with a first group of engine cylinders and a second portion connected with a second group of engine cylinders. The first and second portions of the exhaust manifold 3 communicate with each other via a connecting conduit 3*a*.

A first turbocharger 7 and a second turbocharger 8 are provided so as to be in parallel with each other with respect to the engine 1. The first turbocharger 7 is operated throughout all intake air quantities, and the second turbocharber 8 is operated only at large intake air quantities. The first turbocharger 7 includes a turbine 7*a* and a compressor 7*b* driven by the turbine 7*a*. Similarly, the second turbocharger 8 includes a turbine 8*a* and a compressor 8*b* driven by the turbine 8*a*. The turbine 7*a* is connected with the first portion of the exhaust manifold 3 and the turbine 8*a* is connected with the second portion of the exhaust manifold 3. As a result, the first and second turbines 7*a* and 8*a* are connected with the engine exhaust outlet via the exhaust manifold 3. On the other hand, the compressor 7*b* and the compressor 8*b* are connected with the air intake of the engine 1 via an intake line.

The intake line includes a first intake conduit 15 positioned upstream of the compressors 7*b* and 8*b* and a second intake conduit 14 positioned downstream of the compressors 7*b* and 8*b*. In the first intake conduit 15, an air cleaner 23 and an air flow meter 24 are installed in that order in an intake air flow direction. Further, in the second intake conduit 14, an intercooler 6, an intake throttle valve 4, and a surge tank 2 are installed in that order in the intake air flow direction. An exhaust conduit 20, connected to the engine outlet, includes a first portion of the exhaust conduit in which the turbine 7*a* is installed, a second portion of the exhaust conduit in which the turbine 8*a* is installed, and a third portion of the exhaust conduit in which catalytic converter 21 and 22 (see FIG. 1) are installed. Further, an oxygen sensor 19 is installed in the vicinity of a connecting portion of the first portion and second portion of the exhaust conduit.

For the purpose of switching the operation between a "one-turbocharger-operation" and a "two-turbocharger-operation", an exhaust switching valve 17 is installed in the second portion of the exhaust conduit 20 downstream of the turbine 8*a*, and an intake switching valve 18 is installed in the second intake air conduit 14 downstream of the compressor 8*b*. When both the exhaust switching valve 17 and the intake switching valve 18 are closed, the operation of the second turbocharger 8 is stopped and only the first turbocharger 7 is in operation. In contrast, when both the exhaust switching valve 17 and the intake switching valve 18 are opened, both the first turbocharger 7 and the second turbocharger 8 are in operation.

For the purpose of minimizing the shock which typically accompanies the transition from one-turbocharger-operation to two-turbocharger-operation, the second turbocharger 18 should be run-up before it is fully rotated. For this running-up, an exhaust bypass conduit 40 is provided bypassing the exhaust switching valve 17 and an exhaust bypass valve 41 is installed in the exhaust bypass conduit 40. When the exhaust bypass valve 41 is opened, a relatively small amount of exhaust gas flows through the exhaust bypass conduit 40 so that the second turbocharger 8 can be run-up.

An intake bypass conduit 13 is provided to bypass the compressor 8*b* of the second turbocharger 8. Further, an intake bypass valve 33 is installed in the intake bypass conduit 13. When the second turbocharger 8 is preliminarily rotated, the intake bypass valve 33 is opened to minimize an intake air temperature increase. An intake switching valve bypass conduit is provided so as to bypass the intake switching valve 18, and a check valve 12 is installed in the intake switching valve bypass conduit. When the intake switching valve 18 is closed and the compressor outlet pressure of the second turbocharger 8 grows to exceed a compressor outlet pressure of the first turbocharger 7, the check valve 12 opens the bypass conduit 34 and permits the intake air to flow through the check valve 12. Further, the turbine 7*a* is provided with a waste gate valve 31. A positive pressure tank 51 is provided so as to be connected with a portion of the intake conduit 14 upstream of the intercooler 6 and to hold a charging pressure therein.

Various actuators are provided to operate the above-described valves. More particularly, the waste gate valve 31 is operated by an actuator 9, the intake bypass valve 33 is operated by an actuator 10, the intake switching valve 18 is operated by an actuator 11, the exhaust switching valve 17 is operated by an actuator 16, and the exhaust bypass valve 41 is operated by the actuator 42. Each of these actuators comprises a single diaphragm-type actuator.

Various three-way or two-way solenoid valves 25, 26, 27, 28, 32, and 35 are provided to switch on and off the actuators 9, 10, 11, 16, and 42. These solenoid valves 25, 26, 27, 28, 32, and 35 operate according to the instructions from an engine control computer 29.

Various sensors for sensing the engine operating conditions are provided and the outputs of the sensors are fed to the engine control computer 29. More particularly, the various sensors include an intake pressure sensor 30, a throttle opening degree detecting sensor 5, an intake air quantity detecting sensor such as an air flow meter 24, the aforementioned oxygen sensor 19, and an engine speed sensor 50 or a crank angle sensor (not shown), and a vehicle speed sensor (not shown).

The engine control computer 29 includes a central processor unit (CPU), a read-only memory (ROM), a random access memory (RAM), an input and output interface (I/O interface), and an analogue/digital convertor (A/D convertor) such as the typical micro computer.

Figure 1:
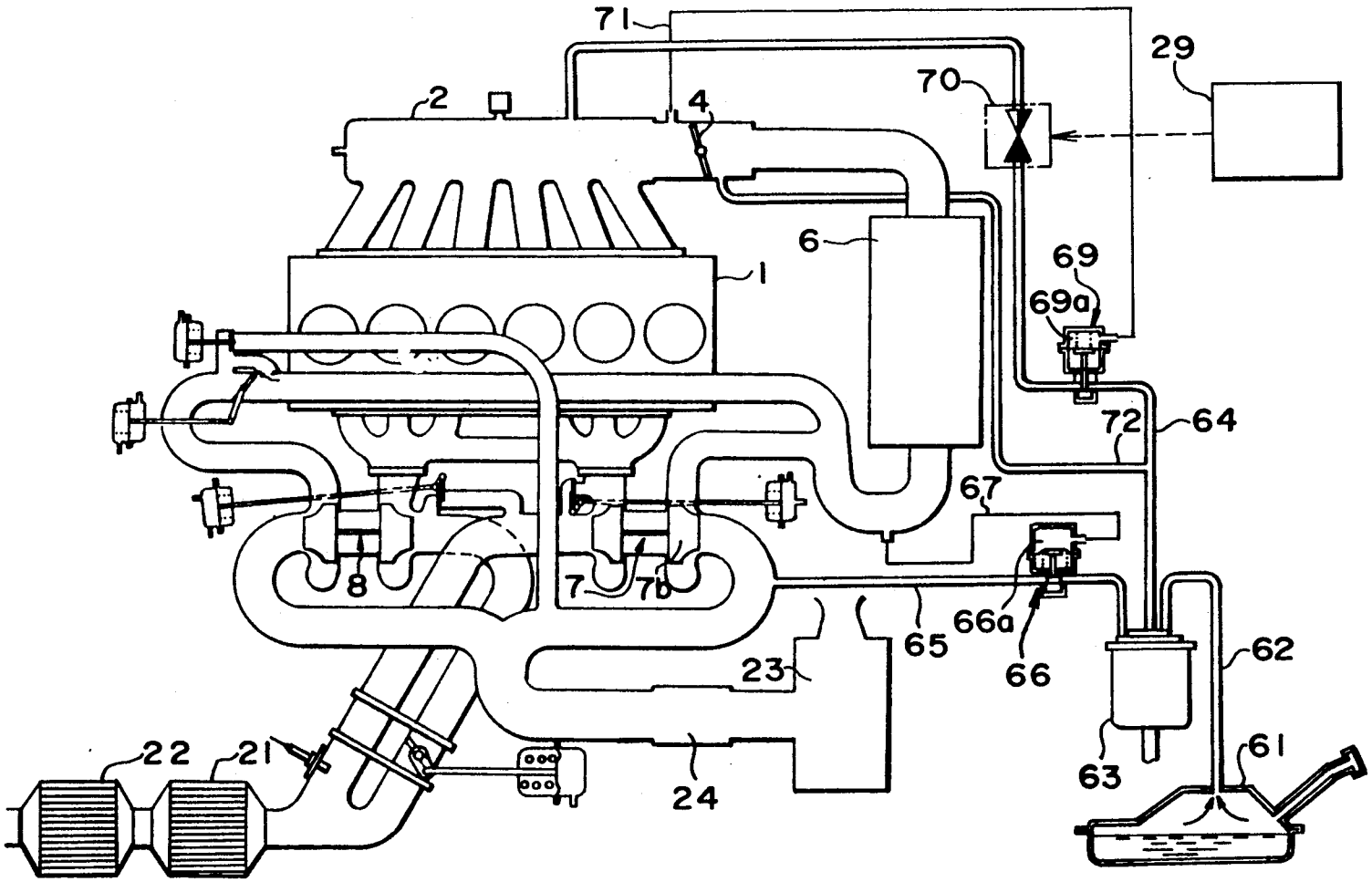
FIG. 1 is a schematic system diagram of an evaporated fuel discharge suppressing apparatus in accordance with a first embodiment of the present invention.
Figure 5:
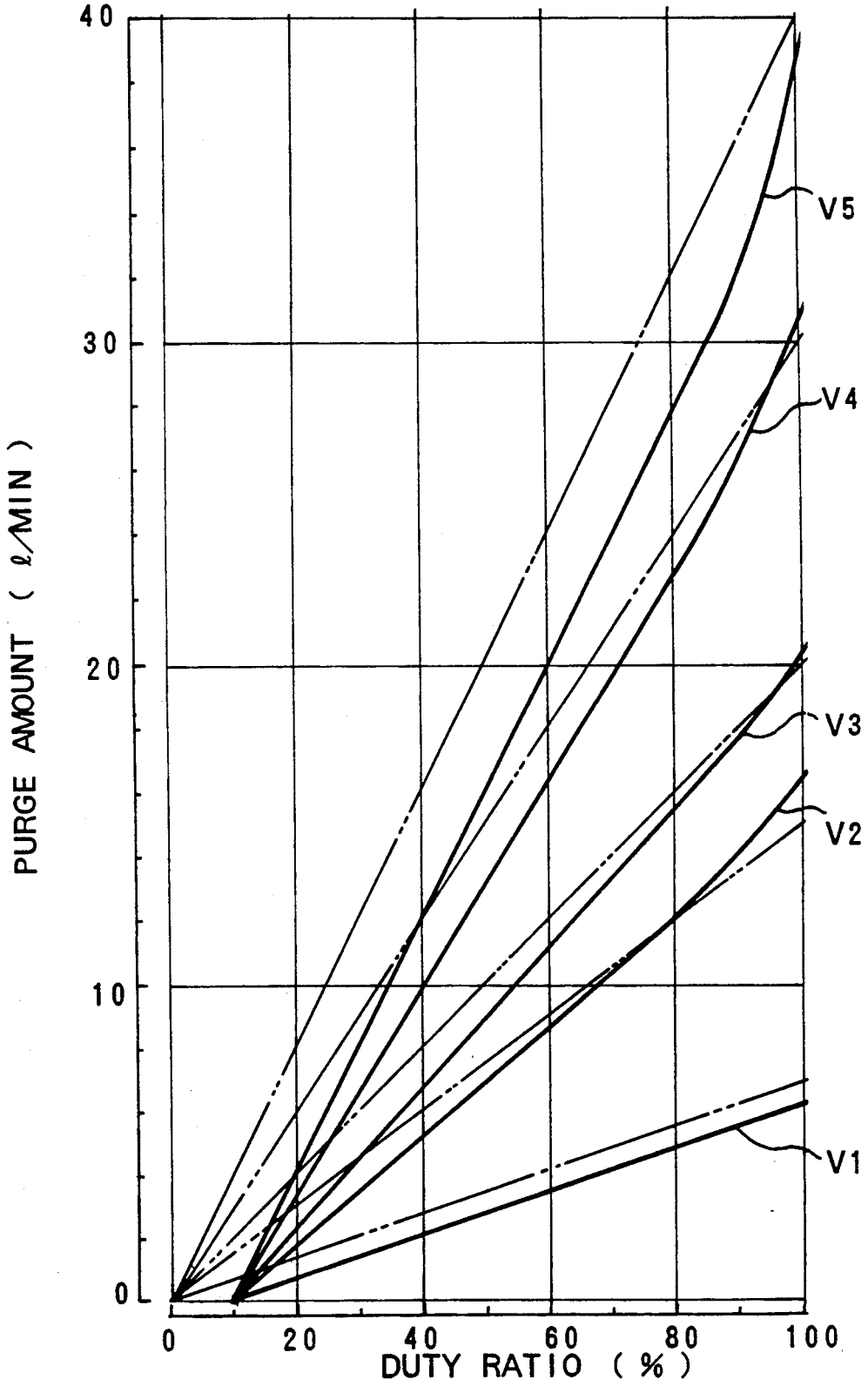
FIG. 5 is a graphical representation of a purge amount versus duty ratio characteristic.

FIG. 1 illustrates an evaporated fuel discharge suppressing apparatus which is mounted to an internal combustion engine, for example, to the internal combustion engine with a dual turbocharger system of FIG. 2. In FIG. 1, a fuel tank 61 is mounted to the automobile. A canister 63, for example a charcoal canister, for adsorbing evaporated fuel generated in the fuel tank 61, is connected to the fuel tank 61 by an evaporated fuel conduit 62. A main purge conduit 64 connects the canister 63 and a portion of the intake conduit 14 downstream of the intake throttle valve 4. A purge control solenoid valve 70 is installed in the main purge conduit 64 so as to control the purge amount of evaporated fuel from the canister 63 into the intake conduit 14 by duty control in response to an engine operating condition. The purge control solenoid valve 70 is operated in response to the instructions from the engine control computer 29. The opening degree of the purge control solenoid valve 70 can be changed to any opening degree by selecting the duty ratio of the solenoid valve, which is well known as a ratio of an electricity current time period to a one cycle time period. Particularly, the ratio is A/(A+B), where A is an electricity current time period, and B is an electricity non-current time period of one cycle. FIG. 5 illustrates one example of relationship between the purge amount of evaporated fuel and the duty ratio. In FIG. 5, Vn (n=1, 2, . . . ) illustrates the size of the solenoid valve.

A bypass purge conduit 72 is provided so as to bypass the purge control solenoid valve 70. More particularly, the bypass purge conduit 72 has an upstream end and a downstream end. The upstream end of the bypass purge conduit 72 is connected to either one of the canister 63 and a portion of the main purge conduit 64 upstream of the purge control solenoid valve 70. The downstream end of the bypass purge conduit 72 is connected to either one of the intake conduit 14 of the engine 1 and a portion of the main purge conduit 64 downstream of the purge control solenoid valve 70.

Further, a subsidiary purge conduit 65 is provided so as to connect the canister 63 and a portion of the intake conduit 15 of the turbocharged engine 1 upstream of the first turbocharger compressor 7*b*. A subsidiary purge control valve 66 is installed in the subsidiary purge conduit 65 so that the subsidiary purge control valve 66 is opened only when an intake pressure of the portion of the intake conduit 15 of the turbocharged engine 1 upstream of the turbocharger compressor 7*b* is negative.

The subsidiary purge control valve 66 may be a vacuum switching valve which is opened by a charging pressure of the turbocharged engine 1 (a pressure of the portion of the intake conduit 14 of the turbocharged engine 1 downstream of the turbocharger compressor 7*b*). More particularly, the vacuum switching valve-type subsidiary purge control valve 66 has a diaphragm chamber 66*a* to which the charging pressure is lead via a charging pressure conduit 67. When the charging pressure is high and the intake pressure of the intake conduit 15 upstream of the first turbocharger compressor 7*b* is negative, the subsidiary purge control valve 66 is opened. The subsidiary purge control valve 66 may be replaced by a check valve 66' (FIG. 10) which allows the evaporated fuel from the canister 63 to flow only in a direction toward the portion of the intake conduit 15 of the turbocharged engine 1 upstream of the turbocharger compressor 7*b*.

Since the negative pressure in the intake conduit 15 upstream of the first turbocharger compressor 7*b* is not as strong as that of the negative pressure generated in the portion of the intake conduit 14 downstream of the intake throttle valve 4, a diameter of the subsidiary purge conduit 65 is constructed to be larger than a diameter of the main purge conduit 64.

Figure 3:
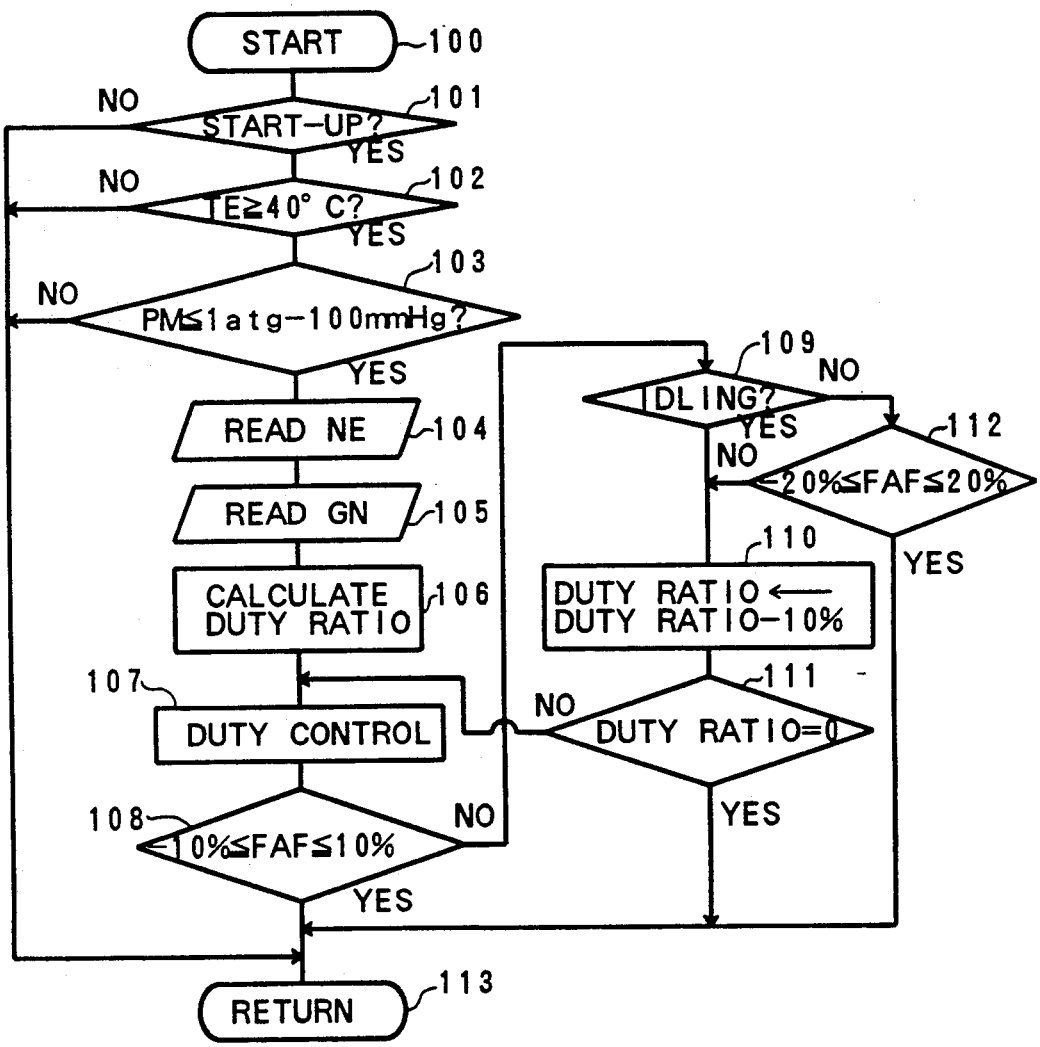
FIG. 3 is a flow chart for purge amount control for the apparatus of FIG. 1.

A control routine for purge amount control as shown in FIG. 3 is stored in the ROM of the engine control computer 29 and calculation according to the control routine of FIG. 3 is executed in the CPU of the engine control computer 29.

The routine is entered at step 100. Then, at steps 101 to 103, it is determined whether or not the current engine operating condition is a condition where evaporated fuel purge can be executed. More particularly, at step 101 it is determined whether the engine has been started, at step 102 it is determined whether the engine has been warmed-up by determining whether the engine cooling water temperature is higher than a predetermined temperature (for example, 40° C.), and at step 103 it is determined whether a sufficient negative pressure is generated in the intake conduit 14 downstream of the intake throttle valve 4 by determining whether the pressure is lower than a predetermined value (for example, the atmospheric pressure—100 mmHg). If the current engine operating condition is a condition where evaporated fuel purge to the intake conduit can be executed at steps 101 through 103, the routine proceeds to steps 10 and 105 where the current engine operating conditions are entered. More particularly, at step 104 the current engine speed NE (the output of the engine speed sensor 50) is entered and at step 105 the intake air quantity GN (the output of the air flow meter 24 is entered.

Figures 6, 7:
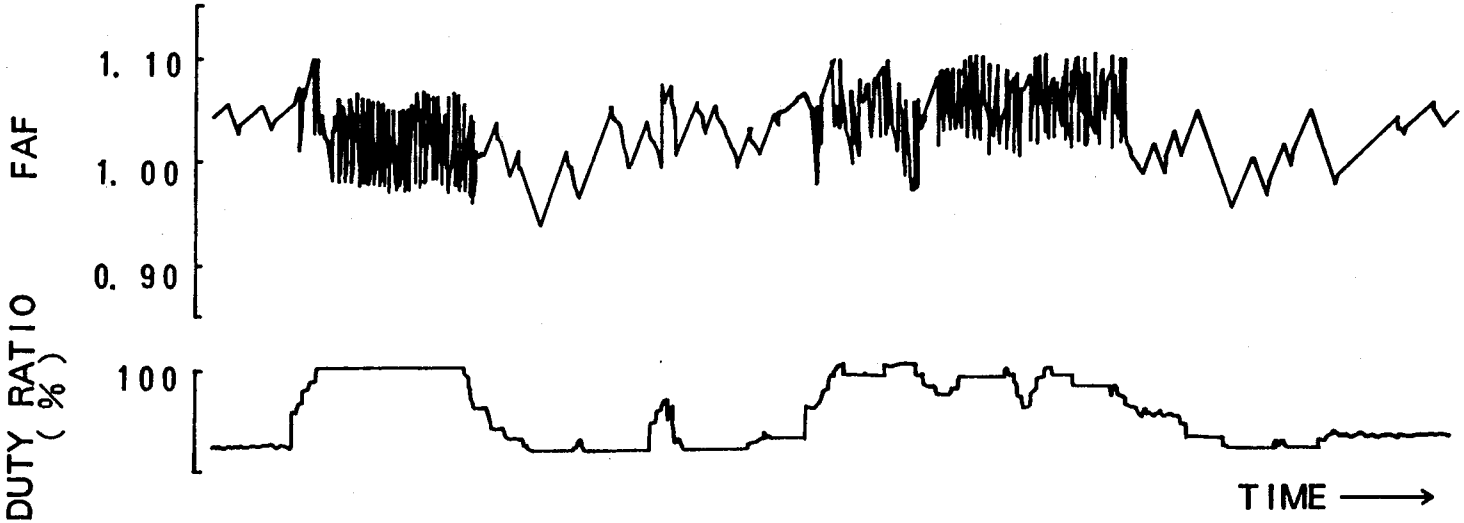
FIG. 6 is a graphical representation of air-fuel ratio, purge rate versus elapse of time characteristic.
FIG. 7 is a map (chart) of a relationship between a duty ratio of a purge control solenoid valve and an engine speed and intake air quantity.

Then, the routine proceeds to step 106, where a duty ratio of the purge control solenoid valve 70 corresponding to the current engine operating condition is calculated using a map of FIG. 7. The map of FIG. 7 predetermines the desirable duty ratios in accordance with the engine speeds and the engine intake air quantities so that an optimum evaporated fuel purge can be conducted. Then, the routine proceeds to step 107 where the duty control of the purge control solenoid valve 70 is executed.

Steps 108 through 111 are steps for preventing the air-fuel ratio of the engine from extreme variations when the evaporated fuel is introduced into the intake conduit of engine. More particularly, at step 108, it is determined whether or not the air-fuel ratio control signal FAF varies within a predetermined range, for example a range between −10% and +10%. If the variance of FAF is in the predetermined range, the variance of the air-fuel ratio will not be large and the routine proceeds to the returning step 113. In contrast, if the variance of FAF exceeds the predetermined range, the routine proceeds to step 109 where it is determined whether or not the engine operating condition is in an idling state. If the engine operating condition is in an idling state, the duty ratio is decreased by a predetermined value, for example, 10% per cycle until the duty ratio becomes zero, so that the variance of the air-fuel ratio is minimized. If the engine operating condition is not an idling state at step 109, the routine proceeds to step 112, where it is determined whether or not FAF varies within a second predetermined range, for example a range between −20% and +20%. If the variance of FAF exceeds the predetermined range at step 112, the routine proceeds to step 110 so that the duty ratio is decreased and the variance of FAF is decreased. If the variance of FAF is within the predetermined range at step 112, the routine proceeds to the returning step 113. In this way, the air-fuel ratio variance due to a change of the opening degree of the purge control valve 70 is restricted to a predetermined range. FIG. 6 illustrates one example of relationships between FAF and the duty ratio.

Figure 4:
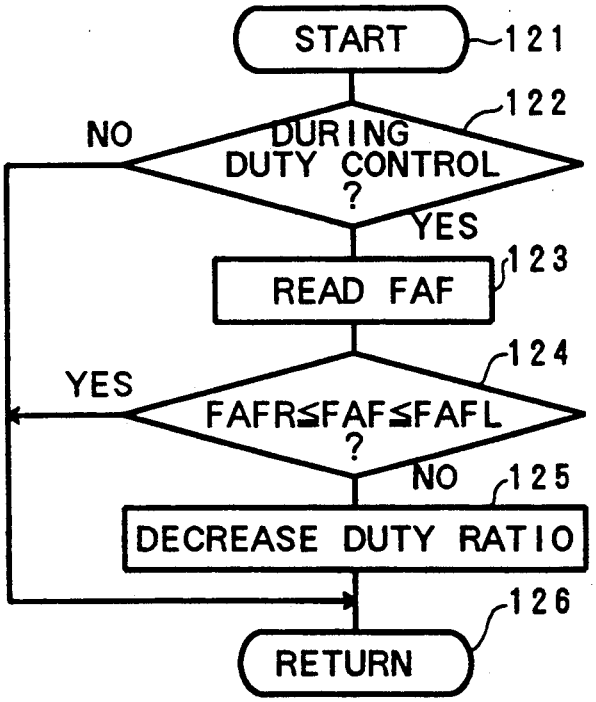
FIG. 4 is a simplified flow chart for purge amount control for the apparatus of FIG. 1.

FIG. 4 illustrates a simplified flow chart of FIG. 3. More particularly, at step 121 this routine is entered. Then, at step 122 it is determined whether or not duty control of the purge control solenoid valve 70 is being executed. If the duty control is being executed at step 122, the routine proceeds to step 123 where the signal FAF is entered. Then, the routine proceeds to step 124, where it is determined whether or not FAF is within a predetermined range, that is, a range between FAFR and FAFL. If FAF exceeds the predetermined range at step 124, the routine proceeds to step 125, where the duty ratio of the purge control solenoid valve 70 is decreased. Then, the routine proceeds to the returning step 126.

Operation of the evaporated fuel discharge suppressing apparatus having the above-described structures common to every embodiment will now be explained.

Evaporated fuel generated in the fuel tank 61 flows to the canister 63 where the evaporated fuel is adsorbed by the canister 63. The adsorbed evaporated fuel is purged into the intake conduit 14 of the engine 1 through the main purge conduit 64 and the bypass purge conduit 72 when the engine 1 is in operation. Further, the adsorbed evaporated fuel is also purged into the intake conduit 15 of the engine 1 through the subsidiary purge conduit 65 when the engine 1 is in operation. The purge amount of the evaporated fuel through the main purge conduit 64 is controlled by controlling the purge control solenoid valve 70 by duty control. In this instance, since the diameter of the bypass purge conduit 72 is smaller than that of the main purge conduit 64, the purge amount control by the purge control solenoid valve 70 will not be greatly disturbed.

If any problem with the purge control solenoid valve 70 occurs due to an accident, such as breakage of an electric lead wire to the solenoid valve 70, and the purge control solenoid valve 70 stops operation in its fully closed state, the evaporated fuel cannot flow through the main purge conduit 64. Even in such a case, since the bypass purge conduit 72 is provided, the evaporated fuel can flow into the intake conduit 14 of the engine 1 through the bypass purge conduit 72, so that saturation of adsorption of the canister 63 does not occur and therefore evaporated fuel from the canister 63 will not discharge into the atmosphere via a canister vent port.

Next, structures and operations different from each other according to respective embodiments will be explained.

FIRST EMBODIMENT

As illustrated in FIGS. 1–7, particularly, in FIG. 1, the downstream end of the bypass purge conduit 72 is connected to a portion of the intake conduit 14 of the engine 1 which is located upstream of the trailing outermost edge of the butterfly-type intake throttle valve 4 when the intake throttle valve 4 is fully closed and is located downstream of the trailing outermost edge of the butterfly-type intake throttle valve 4 when the intake throttle valve 4 is opened.

A vacuum control valve 69 is installed in a portion of the main purge conduit 64 upstream of the purge control solenoid valve 70 and downstream of a connecting portion of the main purge conduit 64 and the bypass purge conduit 72. The vacuum control valve 69 has a diaphragm chamber **69*a* which is connected with a portion of the intake air conduit 14 located downstream of the intake throttle valve 4 when the intake throttle valve 4 is fully closed. When the intake throttle valve 4 is fully closed, the negative pressure in the portion of the intake conduit 14 downstream of the intake throttle valve 4 is lead to the diaphragm chamber 69*a* of the vacuum control valve 69 to close the vacuum control valve 69. Though the purge control solenoid valve 70 is controlled to be closed at the idling state of the engine (see the duty ratio at the small engine speeds and small engine loads in FIG. 3), the vacuum control valve 69 is also closed at the idling state of the engine 1 when the intake throttle valve 4 is closed, and functions to back-up closing of the main purge conduit 64** even if the purge control solenoid valve sticks at its full-open state.

In the first embodiment, the system operates as follows:

When the intake throttle valve 4 is closed, the main purge conduit 64 is closed because both the purge control solenoid valve 70 and the vacuum control valve 69 are closed. Since the bypass purge conduit 72 opens to the portion of the intake conduit 14 upstream of the intake throttle valve 4 at its fully closed state, the evaporated fuel is not drawn through the bypass purge conduit 72. Thus, the evaporated fuel in the canister 63 is not purged.

When the intake throttle valve 4 is fully opened or partially opened, the main purge conduit will be opened because the purge control solenoid valve 70 is controlled to open by duty control and the vacuum switching valve 69 also is opened. Further, since the bypass purge conduit 72 opens to the portion of the intake conduit 14 downstream of the intake throttle valve 4 at its opened state, the evaporated fuel is drawn through the bypass purge conduit 72. Therefore, the evaporated fuel in the canister 63 is purged into the intake conduit 14 of the engine 1, so that the adsorbing ability of the canister 63 recovers.

When the intake air quantity is increased to a large intake air quantity range where both the first turbocharger 7 and the second turbocharger 8 are in operation, the vacuum in the intake conduit 15 upstream of the first turbocharger compressor **7*b* is strong so that the evaporated fuel is also drawn into the intake conduit 15 through the subsidiary purge conduit 65**.

Even if the purge control solenoid valve 70 experiences problems and sticks in the closed position, the bypass purge conduit 72 can purge the evaporated fuel adsorbed by the canister 63 into the intake conduit 14 of the engine 1, so that the evaporated fuel will not be discharged into the atmosphere through a canister vent port and no fuel odor problem will occur.

SECOND EMBODIMENT

Figure 8:
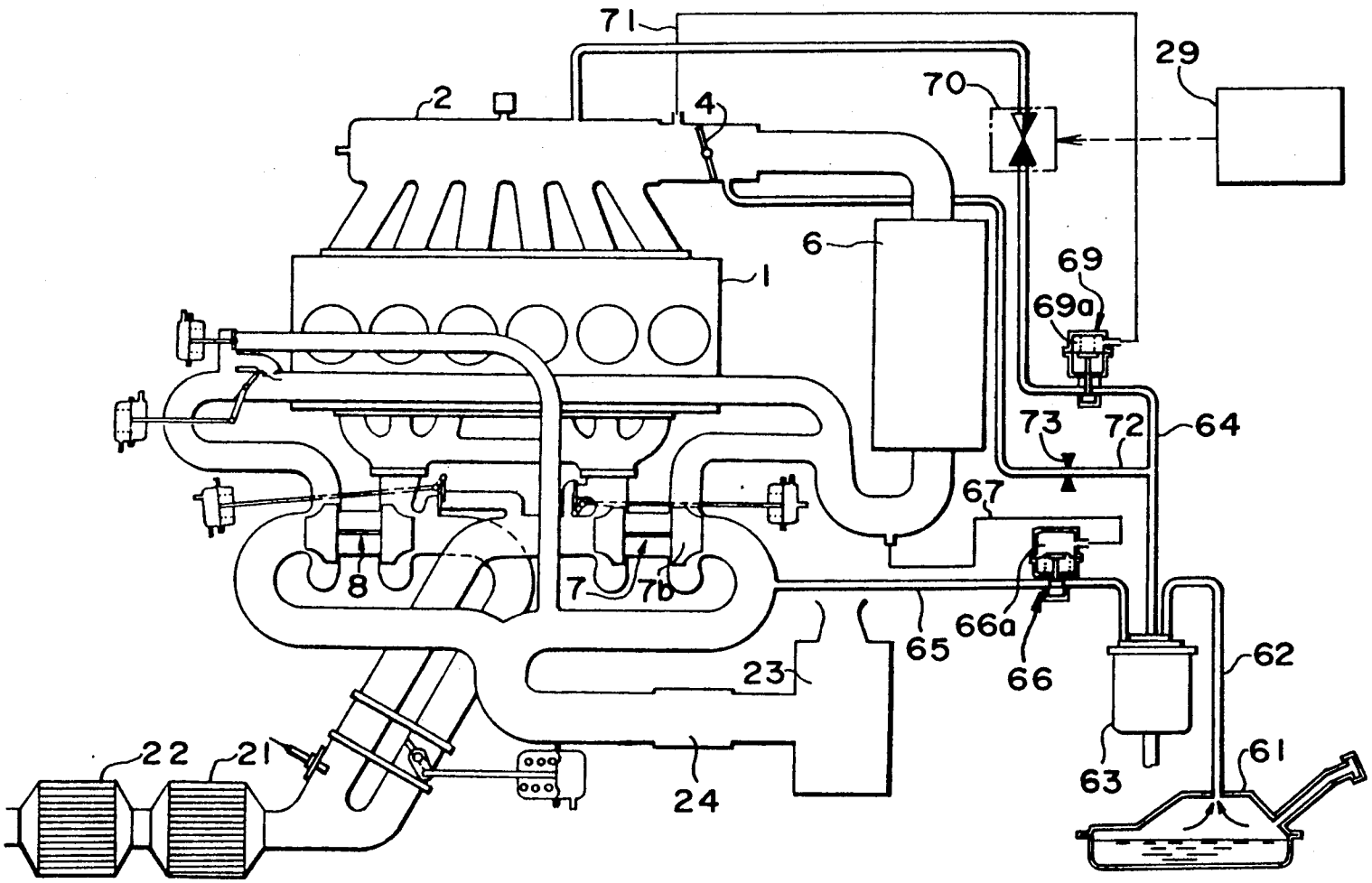
FIG. 8 is a schematic system diagram of an evaporated fuel discharge suppressing apparatus in accordance with a second embodiment of the present invention.

FIG. 8 illustrates an evaporated fuel discharge suppressing apparatus in accordance with a second embodiment of the invention. In the second embodiment, a fixed throttle 73 is provided in the bypass purge conduit 72, so that the amount of evaporated fuel flowing through the bypass purge conduit 72 is limited to a small amount. As a result, the flow through the bypass purge conduit 72 will less affect control of the purge amount of the evaporated fuel by the purge control solenoid valve 70, so that a high purge control is obtained. Other structures and operation are the same as those of the first embodiment, and explanation of the same structures and operation will be omitted by denoting the same members with the same reference numerals as those of the first embodiment.

THIRD EMBODIMENT

Figure 9:
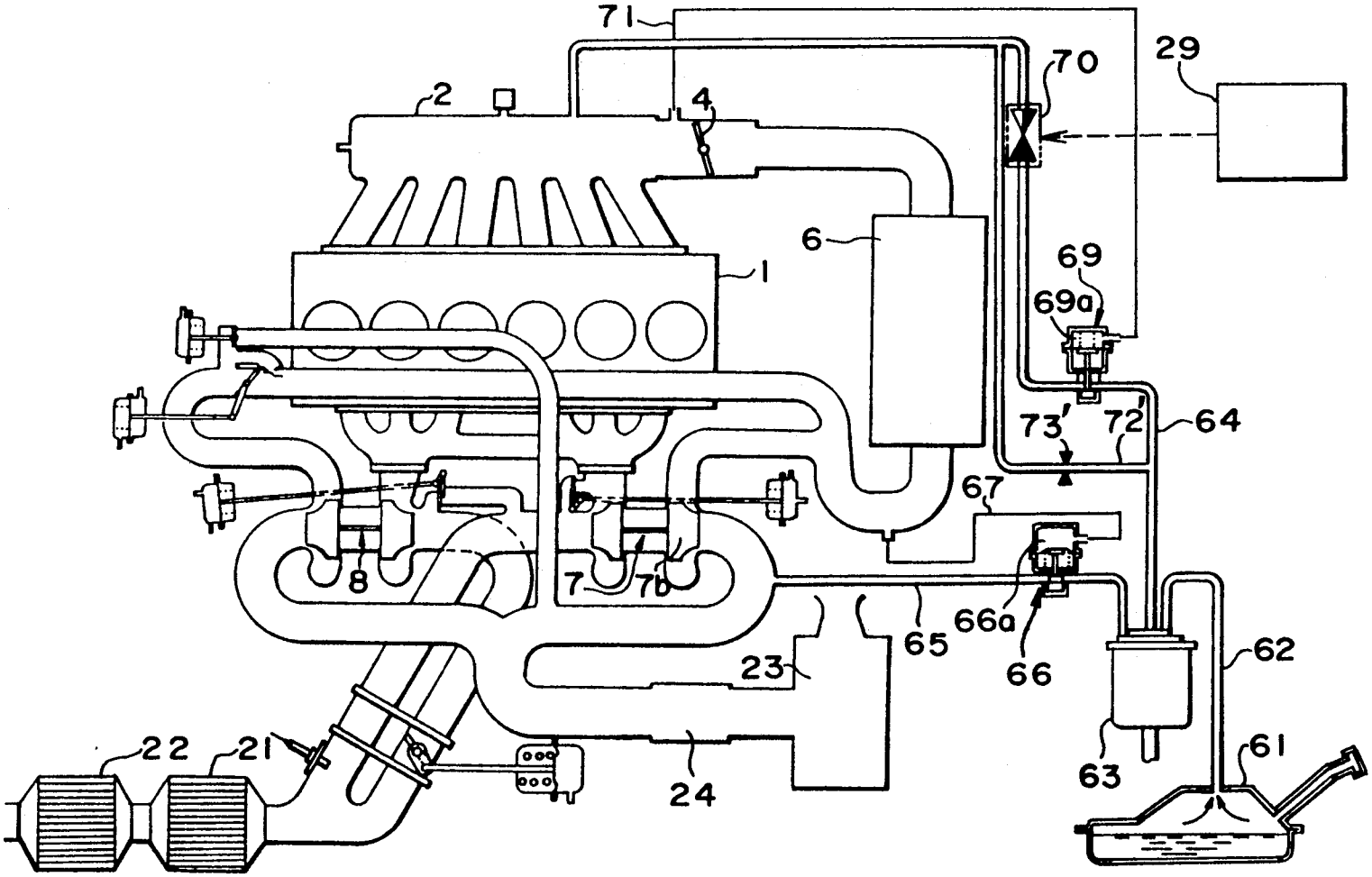
FIG. 9 is a schematic system diagram of an evaporated fuel discharge suppressing apparatus in accordance with a third embodiment of the present invention.

FIG. 9 illustrates an evaporated fuel discharge suppressing apparatus in accordance with a third embodiment of the invention. In the third embodiment, a downstream end of a bypass purge conduit 72' (which corresponds to the bypass purge conduit 72 of the first embodiment) is connected to a portion of the main purge conduit 64 downstream of the purge control solenoid valve 70. Further, a fixed throttle 73' (which corresponds to the fixed throttle 73 of the second embodiment) is provided in the bypass purge conduit 72', so that the amount of evaporated fuel flowing through the bypass purge conduit 72' is limited to a small amount. Other structures of the third embodiment are the same as those of the first embodiment, and explanation of the same members will be omitted by denoting the same members with the same reference numerals as those of the first embodiment.

Operation of the third embodiment is as follows:

When the intake throttle valve 4 is closed, the purge control solenoid valve 70 and the vacuum control valve 69 are closed. However, since the bypass purge conduit 72' opens to the portion of the intake conduit 14 downstream of the intake throttle valve 4, the evaporated fuel is drawn through the bypass purge conduit 72'. Thus, the evaporated fuel in the canister 63 is purged.

When the intake throttle valve 4 is fully opened or partially opened, the main purge conduit 64 will be opened because the purge control solenoid valve 70 is controlled to open by duty control and the vacuum switching valve 69 also is opened. Further, since the bypass purge conduit 72' opens to the portion of the intake conduit 14 downstream of the intake throttle valve 4, the evaporated fuel is drawn through the bypass purge conduit 72'. Therefore, the evaporated fuel in the canister 63 is purged into the intake conduit 14 of the engine 1, so that the adsorbing ability of the canister 63 recovers.

Even if the purge control solenoid valve 70 experiences problems and sticks in the closed position, the bypass purge conduit 72' can purge the evaporated fuel adsorbed by the canister 63 into the intake conduit 14 of the engine 1, so that the evaporated fuel will not be discharged into the atmosphere through a canister vent port and no fuel odor problem occurs.

FOURTH EMBODIMENT

Figure 10:
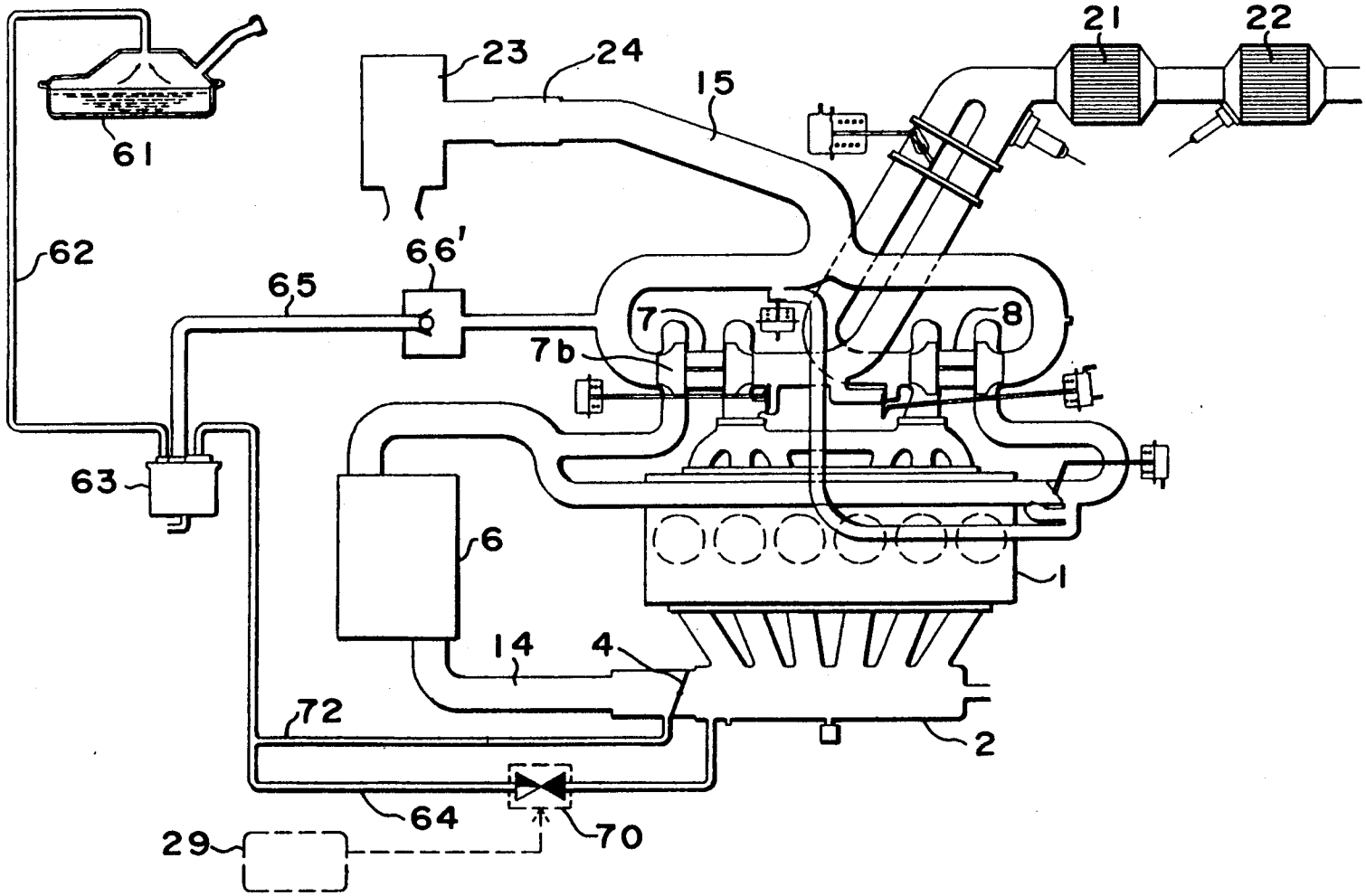
FIG. 10 is a schematic system diagram of an evaporated fuel discharge suppressing apparatus in accordance with a fourth embodiment of the present invention.

FIG. 10 illustrates an evaporated fuel discharge suppressing apparatus in accordance with a fourth embodiment of the invention. The fourth embodiment differs from the first embodiment only in that no vacuum control valve is installed in the main purge conduit 64 in the fourth embodiment while the vacuum control valve 69 is installed in the main purge conduit 64 in the first embodiment. FIG. 10 illustrates the evaporated fuel discharge suppressing system in a reverse state as compared with the system of FIG. 1. Other structures and operation of the fourth embodiment of the invention are the same as the aforementioned structures common to every embodiment and operation thereof.

In accordance with any embodiment of the invention, even if the purge control solenoid valve 70 experiences problems and sticks in an closed position, the evaporated fuel in the canister 63 can be purged into the intake conduit 14 of the engine through the bypass purge conduit 72 and 72', so that the evaporated fuel in the canister 63 will be prevented from being discharged into the atmosphere. Further, the invention can be used with a variety of fuels, including gasoline, ethanol and methanol.

Although four embodiments of the invention have been described in detail above, it will be appreciated by those skilled in the art that various modifications and alterations can be made to the particular embodiments shown without materially departing from the novel teachings and advantages of the present invention. Accordingly, it is to be understood that all such modifications and alterations are included within the spirit and scope of the present invention as defined by the following claims.

What is claimed is:

1. An evaporated fuel discharge suppressing apparatus for an internal combustion engine comprising:

an internal combustion engine having an intake conduit in which a butterfly-type intake throttle valve is installed;

a fuel tank;

a canister, connected to the fuel tank through an evaporated fuel conduit, for adsorbing evaporated fuel generated in the fuel tank and flowing to the canister;

a main purge conduit connecting the canister and a portion of the intake conduit downstream of the butterfly type intake throttle valve;

a purge control solenoid valve, installed in the main purge conduit, for controlling a purge amount of evaporated fuel by duty control in response to an engine operating condition; and a bypass purge conduit which is independent of the main purge conduit, having an upstream end and a downstream end and bypassing the purge control solenoid valve, the upstream end of the bypass purge conduit being connected to either one of the canister and a portion of the main purge conduit upstream of the purge control solenoid valve, and the downstream end of the bypass purge conduit being connected to a portion of the intake conduit of the engine which is located upstream of a trailing, outermost edge of said butterfly-type intake throttle valve when the butterfly-type intake throttle valve is fully closed and is downstream of said trailing outermost edge when the butterfly-type intake throttle valve is fully opened.

2. An evaporated fuel discharge suppressing apparatus for an internal combustion engine according to claim 1, wherein the bypass purge conduit has a diameter smaller than the main purge conduit.

3. An evaporated fuel discharge suppressing apparatus for an internal combustion engine according to claim 1, and further comprising a vacuum control valve installed in series with the purge control solenoid valve and located at a portion of the main purge conduit between the purge control solenoid valve and the upstream end of the bypass purge conduit and operated to close the main purge conduit by an intake vacuum generated in a portion of the intake conduit of the engine downstream of the butterfly-type intake throttle valve when the butterfly-type intake throttle valve is fully closed.

4. An evaporated fuel discharge suppressing apparatus for an internal combustion engine according to claim 1, wherein the internal combustion engine comprises a turbocharged engine having a turbocharger compressor installed in the intake conduit of the engine, and further comprising:

a subsidiary purge conduit connecting the canister and a portion of the intake conduit of the turbocharged engine upstream of the turbocharger compressor; and a subsidiary purge control valve installed in the subsidiary purge conduit and opened only when an intake pressure of a portion of the intake conduit of the turbocharged engine upstream of the turbocharger compressor is negative.

5. An evaporated fuel discharge suppressing apparatus for an internal combustion engine according to claim 4, wherein the subsidiary purge control valve comprises a check valve which allows the evaporated fuel to flow only in a direction from the canister toward the portion of the intake conduit of the turbocharged engine upstream of the turbocharger compressor.

6. An evaporated fuel discharge suppressing apparatus for an internal combustion engine according to claim 4, wherein the subsidiary purge control valve comprises a vacuum control valve which is opened by a charging pressure of the turbocharged engine.

7. An evaporated fuel discharge suppressing apparatus for an internal combustion engine according to claim 4, wherein the subsidiary purge conduit has a diameter larger than the main purge conduit.

8. An evaporated fuel discharge suppressing apparatus for an internal combustion engine according to claim 4, wherein the turbocharged engine comprises an engine with a dual turbocharger system having a first turbocharger operated at all intake air quantities and a second turbocharger operated at large intake air quantities only.

9. An evaporated fuel discharge suppressing apparatus for an internal combustion engine according to claim 8, wherein the subsidiary purge conduit is connected to a portion of the intake conduit of the engine upstream of the compressor of the first turbocharger.

10. An evaporated fuel discharge suppressing apparatus for an internal combustion engine according to claim 1, further comprising decision means for determining whether or not a current air-fuel ratio variance exceeds a predetermined range when evaporated fuel purge from the canister to the intake conduit of the engine is being executed and for decreasing a duty ratio of the purge control solenoid valve when the air-fuel ratio variance is determined to exceed the predetermined value.

11. An evaporated fuel discharge suppressing apparatus for an internal combustion engine according to claim 1, further comprising a fixed throttle installed in the bypass purge conduit.

12. An evaporated fuel discharge suppressing apparatus for an internal combustion engine comprising:

a turbocharged internal combustion engine having an intake conduit in which an intake throttle valve is installed, the engine having a turbocharger compressor installed in the intake conduit;

a fuel tank;

a canister, connected to the fuel tank through an evaporated fuel conduit, for adsorbing evaporated fuel generated in the fuel tank and flowing to the canister;

a main purge conduit connecting the canister and a portion of the intake conduit of the engine downstream of the intake throttle valve;

a purge control solenoid valve, installed in the main purge conduit, for controlling the purge amount of evaporated fuel by duty control in response to an engine operating condition;

a bypass purge conduit having an upstream end and a downstream end and bypassing the purge control solenoid valve, the upstream end of the bypass purge conduit being connected to either one of the canister and a portion of the main purge conduit upstream of the purge conduit solenoid valve, and the downstream end of the bypass purge conduit being connected to a portion of the main purge conduit downstream of the purge control solenoid valve, the bypass purge conduit having a diameter smaller than the main purge conduit;

a subsidiary purge conduit connecting the canister and a portion of the intake conduit of the turbocharged engine upstream of the turbocharger compressor; and a subsidiary purge control valve installed in the subsidiary purge conduit and opened only when an intake pressure of a portion of the intake conduit of the turbocharged engine upstream of the turbocharger compressor is negative.

13. An evaporated fuel discharge suppressing apparatus for an internal combustion engine according to claim 12, and further comprising a vacuum control valve installed in series with the purge control solenoid valve and located at a portion of the main purge conduit between the purge control solenoid valve and the upstream end of the bypass purge conduit and operated to close the main purge conduit by an intake vacuum generated in a portion of the intake conduit of the engine downstream of the intake throttle valve when the intake throttle valve is fully closed.

14. A evaporated fuel discharge suppressing apparatus for an internal combustion engine according to claim 12, wherein the subsidiary purge control valve comprises a check valve which allows the evaporated fuel to flow only in a direction from the canister toward a portion of the intake conduit of the turbocharged engine upstream of the turbocharger compressor.

15. An evaporated fuel discharge suppressing apparatus for an internal combustion engine according to claim 12, wherein the subsidiary purge control valve comprises a vacuum control valve which is opened by a charging pressure of the turbocharged engine.

16. An evaporated fuel discharge suppressing apparatus for an internal combustion engine according to claim 12, wherein the subsidiary purge conduit has a diameter larger than the main purge conduit.

17. An evaporated fuel discharge suppressing apparatus for an internal combustion engine according to claim 12, wherein the turbocharged engine comprises an engine with a dual turbocharger system having a first turbocharger operated at all intake air quantities and a second turbocharger operated at large intake air quantities only.

18. An evaporated fuel discharge suppressing apparatus for an internal combustion engine according to claim 17, wherein the subsidiary purge conduit is connected to a portion of the intake conduit of the engine upstream of the compressor of the first turbocharger.

19. An evaporated fuel discharge suppressing apparatus for an internal combustion engine comprising:

an internal combustion engine having an intake conduit in which a butterfly-type intake throttle valve is installed;

a fuel tank;

a canister, connected to the fuel tank through an evaporated fuel conduit, for adsorbing evaporated fuel generated in the fuel tank and flowing to the canister;

a main purge conduit connecting the canister and a portion of the intake conduit downstream of the butterfly type intake throttle valve;

a purge control solenoid valve, installed in the main purge conduit, for controlling a purge amount of evaporated fuel by duty control in response to an engine operating condition;

a vacuum control valve installed in series with the purge control solenoid valve and located at a portion of the main purge conduit between the purge control solenoid valve and the upstream end of the bypass purge conduit, and operated to close the main purge conduit by an intake vacuum generated in a portion of the intake conduit of the engine downstream of the intake throttle valve when the intake throttle valve is closed; and a bypass purge conduit which is independent of the main purge conduit, having an upstream end and a downstream end and bypassing both the purge control solenoid valve and the vacuum control valve, the upstream end of the bypass purge conduit being connected to either one of the canister and a portion of the main purge conduit upstream of both the purge control solenoid valve and vacuum control valve, and the downstream end of the bypass purge conduit being connected to a portion of the intake conduit of the engine which is located upstream of the butterfly-type intake throttle valve.

20. An evaporated fuel discharge suppressing apparatus for an internal combustion engine comprising:

an internal combustion engine having an intake conduit in which a butterfly-type intake throttle valve is installed;

a fuel tank;

a canister, connected to the fuel tank through an evaporated fuel conduit, for adsorbing evaporated fuel generated in the fuel tank and flowing to the canister;

a main purge conduit connecting the canister and a portion of the intake conduit of the engine downstream of the butterfly type intake throttle valve;

a purge control solenoid valve, installed in the main purge conduit, for controlling a purge amount of evaporated fuel by duty control in response to an engine operating condition;

a vacuum control valve installed in series with the purge control solenoid valve and located at a portion of the main purge conduit between the purge control solenoid valve and the upstream end of the bypass purge conduit, and operated to close the main purge conduit by an intake vacuum generated in a portion of the intake conduit of the engine downstream of the butterfly-type intake throttle valve when the butterfly-type intake throttle valve is closed; and a bypass purge conduit which is independent of the main purge conduit, having an upstream end and a downstream end and bypassing both the purge control solenoid valve and the vacuum control valve, the upstream end of the bypass purge conduit being connected to either one of the canister and a portion of the main purge conduit upstream of both the purge control solenoid valve and vacuum control valve, and the downstream end of the bypass purge conduit being connected to a portion of the main purge conduit downstream of both the purge control solenoid valve and the vacuum control valve, the bypass purge conduit having a diameter smaller than the main purge conduit.

* * * * *